US011499277B2

(12) United States Patent
Stinner et al.

(10) Patent No.: US 11,499,277 B2
(45) Date of Patent: Nov. 15, 2022

(54) CONSTRUCTION MACHINES

(71) Applicant: Wirtgen GmbH, Windhagen (DE)

(72) Inventors: Tobias Stinner, Nister (DE); Christian Berning, Zülpich (DE); Andreas Salz, Neustadt (DE)

(73) Assignee: Wirtgen GmbH

( * ) Notice: Subject to any disclaimer, the term of this patent is extended or adjusted under 35 U.S.C. 154(b) by 0 days.

(21) Appl. No.: 17/382,939

(22) Filed: Jul. 22, 2021

(65) Prior Publication Data

US 2022/0034050 A1 Feb. 3, 2022

(30) Foreign Application Priority Data

Jul. 31, 2020 (DE) ..... 10 2020 120 243.1

(51) Int. Cl.
*E01C 23/088* (2006.01)
*E01C 23/06* (2006.01)
(Continued)

(52) U.S. Cl.
CPC ..... *E01C 23/088* (2013.01); *E01C 23/065* (2013.01); *E01C 23/127* (2013.01); *E21C 47/00* (2013.01); *E01C 2301/00* (2013.01)

(58) Field of Classification Search
CPC ..... E21C 47/08; E21C 47/00; E21C 47/02; E01C 23/065; E01C 23/088; E01C 23/127; E01C 2301/00
See application file for complete search history.

(56) References Cited

U.S. PATENT DOCUMENTS 3,260,179 A * 7/1966 Moreira ..... E02D 3/026 404/128
6,106,073 A 8/2000 Simons et al.
(Continued)

FOREIGN PATENT DOCUMENTS

DE 19631042 A1 2/1998
EP 2037042 A1 3/2009
(Continued)

OTHER PUBLICATIONS

European Patent Office Search Report for corresponding patent application No. 21186711.4, dated Dec. 13, 2021, 4 pages (not prior art).

*Primary Examiner* — Abby J Flynn
*Assistant Examiner* — Michael A Goodwin
(74) *Attorney, Agent, or Firm* — Lucian Wayne Beavers; Patterson Intellectual Property Law

(57) ABSTRACT

In a self-propelled construction machine (1), in particular road milling machine, stabilizer, recycler or surface miner, comprising a machine frame (2), and at least one working device (6), in particular milling drum, which is arranged in a housing (4) open towards the bottom that is at least partially closed on at least one side by at least one edge protector (8) height-adjustable relative to the machine frame (2), wherein, for the purpose of height adjustment, at least one first lifting device (10) is provided, the first end (15) of which is connected to the machine frame (2), and the second end (16) of which is connected to the height-adjustable edge protector (8), it is provided for the following features to be achieved: a second lifting device (12) is provided, the first end (18) of which is connected to the machine frame (2), and the second end (20) of which is connected to a first end (22) of a transmission device (14), which is in turn connected,
(Continued)

with a second end (24), to the height-adjustable edge protector (8).

19 Claims, 3 Drawing Sheets

(51) Int. Cl.
*E21C 47/00* (2006.01)
*E01C 23/12* (2006.01)

(56) References Cited

U.S. PATENT DOCUMENTS

| | | | | |
|---|---|---|---|---|
| 8,632,132 | B2 | 1/2014 | Menzenbach et al. | |
| 9,016,798 | B2 | 4/2015 | Berning et al. | |
| 10,370,802 | B1 * | 8/2019 | Hogan | E01C 19/176 |
| 2009/0074510 | A1 | 3/2009 | von Schoenebeck et al. | |
| 2009/0282797 | A1 * | 11/2009 | Ogata | A01D 43/0635 56/202 |
| 2015/0076892 | A1 * | 3/2015 | Emme | E01C 23/088 299/10 |
| 2017/0254032 | A1 * | 9/2017 | Husar | E01C 23/088 |
| 2017/0362784 | A1 * | 12/2017 | Hoffmann | E01C 23/088 |
| 2020/0095738 | A1 | 3/2020 | Sturos | |

FOREIGN PATENT DOCUMENTS

| | | | |
|---|---|---|---|
| EP | 2374937 | A2 | 10/2011 |
| EP | 2695994 | A1 | 2/2014 |
| WO | 2020135923 | A1 | 7/2020 |

* cited by examiner

CONSTRUCTION MACHINES

BACKGROUND OF THE INVENTION

1. Field of the Invention

The present invention relates to a self-propelled construction machine, in particular road milling machine, stabilizer, recycler or surface miner, and to a method for height-adjusting an edge protector of a construction machine, in particular road milling machine, stabilizer, recycler or surface miner.

2. Description of the Prior Art

Self-propelled construction machines, in particular road milling machines, recyclers, stabilizers or surface miners, are known, which comprise at least one machine frame, a minimum of three travelling devices and at least one working device, in particular a milling drum, for working the ground pavement. The at least one working device, in particular milling drum, is preferably arranged in a housing open towards the bottom that is at least partially closed on at least one side by at least one edge protector height-adjustable relative to the machine frame, wherein, for the purpose of height adjustment, at least one first lifting device is provided, the first end of which is connected to the machine frame, and the second end of which is connected to the height-adjustable edge protector.

The housing open towards the bottom may be closed towards the front as seen in the direction of operation, and towards the rear as seen in the direction of operation. A hold-down device may be provided, for example, towards the front as seen in the direction of operation, and a scraper device may be arranged towards the rear as seen in the direction of operation. On the sides, the housing open towards the bottom may be at least partially closed by one each height-adjustable edge protector extending essentially in the longitudinal direction of the construction machine. The edge protector may also be termed side plate.

The at least one edge protector may be raised and lowered. The edge protector may rest on the ground. During the advance movement of the construction machine, the edge protector may then be pulled across the ground. In the process, the edge protector may additionally be loaded or relieved by applying a predetermined force. A height-adjustable edge protector has been described, for example, in EP 2695994 (U.S. Pat. No. 9,016,798).

The edge protector may be raised, for example, if an obstacle is to be avoided, or when driving onto a curb, for example, or if jamming is to be prevented. During the operation of the construction machine, however, the edge protector is preferably lowered so that the housing is closed.

If the working device is a milling drum, the edge protector preferably rests on the milling edge next to the end side of the milling drum during operation, that is, on an area that is not milled, where it counteracts fracturing of the area not to be milled, or prevents an escape of the milled material from the housing, respectively.

The road milling machines can be used, for example, to remove existing ground pavements of roads. Recyclers can be used to restore existing ground pavements. The stabilizers serve the purpose of preparing the subgrade for road construction. Surface miners can be used to mine coal and rock.

In the state of the art, such as DE 19631042 (U.S. Pat. No. 6,106,073), for example, construction machines are known, in particular so-called small milling machines, in which a driven travelling device is realized as pivotable travelling devices. A pivotable travelling device may be pivotable about at least one vertical pivoting axis in relation to the machine frame from at least one first pivoted-in into at least one second pivoted-out position. On one side of the machine frame, namely, on the so-called zero-clearance side of the machine frame, the working device may terminate flush with the same. The pivotable travelling device may be arranged on said zero-clearance side of the machine frame, wherein the pivotable travelling device, in the first pivoted-in position, does not project in relation to the machine frame on the zero-clearance side, and, in the at least second pivoted-out position, projects in relation to the zero-clearance side. The pivotable travelling device may preferably be a rear travelling device as seen in forward direction. The working device is preferably arranged on the machine frame in such a fashion that it is positioned between the rear travelling devices when the pivotable travelling device is in its pivoted-out position. When the pivotable travelling device is in the pivoted-in position, it is preferably positioned in front of the working device as seen in forward direction.

The forward direction of travel is the direction in which the milling machine is moving during the intended milling operation, that is, the preferred direction of operation.

In this process, the milling drum typically rotates in the opposite direction to the direction of rotation of the ground-engaging units.

When the working device mills close to the edge along the wall of a house, for example, or a similar obstacle, the pivotable travelling device may be transferred into the first pivoted-in position, which enables the construction machine to drive significantly closer to the obstacle than would be the case if the travelling device were arranged next to the working device and were in the pivoted-out position. On the other hand, when not milling close to the edge, it is desired for the travelling device to be arranged next to the working device so that the machine achieves a more stable support.

In the case of construction machines which are provided with a pivotable travelling device, there exists a problem of space in particular in the area in which the pivoting movement of the travelling device is performed. For this reason, a first lifting device is frequently used as the single lifting device for the edge protector, which frequently leads to the problem that the at least one edge protector may jam during lowering and raising with the aid of the at least one first lifting device.

SUMMARY OF THE INVENTION

It is the object of the present invention to create a construction machine and a method for height-adjusting an edge protector of a construction machine, in which the lifting movement of the edge protector is improved.

The aforementioned object is achieved by a self-propelled construction machine (1), in particular road milling machine, stabilizer, recycler or surface miner, comprising

- a machine frame (2), and
- at least one working device (6), in particular milling drum, which is arranged in a housing (4) open towards the bottom that is at least partially closed on at least one side by at least one edge protector (8) height-adjustable relative to the machine frame (2), wherein, for the purpose of height adjustment, at least one first lifting device (10) is provided, the first end (15) of which is connected to the machine frame (2), and the second end (16) of which is connected to the height-adjustable edge protector (8), wherein a second lifting device (12)

is provided, the first end (18) of which is connected to the machine frame (2), and the second end (20) of which is connected to a first end (22) of a transmission device (14), which is in turn connected, with a second end (24), to the height-adjustable edge protector (8).

Further the aforementioned object is achieved by a method for height-adjusting an edge protector (8) of a construction machine (1), in particular road milling machine, stabilizer, recycler or surface miner, by means of adjusting the edge protector (8) by means of at least one first lifting device (10), which, on a first end, is connected to the machine frame, and, on a second end, is connected to the height-adjustable edge protector (8), wherein a second lifting device (12) is used for adjustment in addition to the first lifting device (10), wherein the second lifting device (12) applies the force for adjusting the edge protector (8) to a transmission device (14), and the transmission device (14) transmits the force to the edge protector (8).

The invention advantageously provides that a second lifting device is provided, the first end of which is connected to the machine frame, and the second end of which is connected to a first end of a transmission device, which is in turn connected, with a second end, to the height-adjustable edge protector.

The present invention has the advantage that a transmission device is used in lieu of a direct arrangement of the second lifting device on the edge protector. Said transmission device can be realized requiring significantly less space than a lifting device. This allows the lifting device to be arranged in an area where there is sufficient space available. Furthermore, the point of application of the force acting on the edge protector by means of the transmission devices may also be arbitrarily selected.

The first and/or second lifting device may also be termed an actuator. The first and/or second lifting device may be a piston-cylinder unit. It is not mandatory for the first and the second lifting device to be piston-cylinder units; for example, a spindle drive or linear actuators may also be used.

The transmission device may preferably transmit force in two directions of force, so that the edge protector may be raised or lowered with the aid of the transmission device.

For the purposes of the present application, all parts rigidly connected to the supporting structure are part of the machine frame. All parts of the housing that are rigidly connected to the supporting structure of the construction machine are therefore also part of the machine frame.

In the preferred embodiment, the operator's platform and the working device of the construction machine are positioned in the area of the rear ground-engaging units as seen in the preferred direction of operation, one of which has been realized in pivotable design as described above. In this arrangement, at least the rear ground-engaging units are realized in height-adjustable design to allow adjustment of the milling depth.

The second end of the first lifting device may be connected to the height-adjustable edge protector in the rear section of the edge protector as seen in the direction of travel of the construction machine. The second end of the transmission device is preferably connected to the front section of the edge protector as seen in the direction of travel of the construction machine, wherein the front section of the edge protector is that section of the height-adjustable edge protector which is located in front of the center of gravity of the height-adjustable edge protector as seen in the direction of travel of the construction machine, wherein the rear section of the height-adjustable edge protector is that section of the edge protector which is located behind the center of gravity of the edge protector as seen in the direction of travel of the construction machine.

In the direction of travel may mean both in the forward direction of travel of the construction machines or in the reverse direction of travel of the construction machines.

As a result of the first lifting device being connected to the rear section of the edge protector and the transmission device being connected to the front section of the edge protector, the forces may be optimally distributed across the edge protector so that the edge protector will not jam.

The transmission device may be designed in such a fashion that, by means of the transmission device, the point of application and/or the direction of force of the force of the second lifting device on the edge protector is arbitrarily determinable.

The present invention thus offers the advantage that the point of application and the direction of force of the force of the second lifting device on the edge protector may be optimally determined. The point of application may be determined in such a fashion that the forces of the first and the second lifting device act on the edge protector in a balanced fashion. Also, the direction of force may be optimally adapted to the direction of movement of the edge protector.

The transmission device may be a gear unit or a lever arm. The transmission device may also be a transmission linkage.

The transmission device may comprise at least two, preferably three articulated joints and at least two coupling elements or links.

The coupling elements may be designed as rod elements or rigid links.

The second lifting device may be connected to at least one first coupling element via a first articulated joint, and the edge protector may be connected to at least one second coupling element via a second articulated joint.

The transmission device may be arranged and designed in such a fashion that the transmitted force, which acts from the transmission device on the edge protector, acts essentially perpendicular in relation to the ground surface. In this way, the force preferably acts in the same direction in which the edge protector moves up and down.

The travelling devices may be connected to the machine frame via lifting columns. The machine frame may be adjustable in height by means of the lifting columns. As a result, the working device, in particular milling drum, may also be adjusted in height. The lifting columns may be provided on all travelling devices. However, the lifting columns may, for example, also be arranged only on the rear travelling devices. The construction machine exhibits a longitudinal direction. Said longitudinal direction preferably extends in the direction of travel. When the construction machine is standing on a level ground surface and the front and rear lifting columns are extended to an equal degree, the longitudinal direction is arranged parallel to the ground surface. Furthermore, the construction machine exhibits a vertical direction, which is arranged orthogonal to the longitudinal direction and, when the construction machine is standing on a level ground surface and the front and rear lifting columns are extended to an equal degree, is arranged orthogonal to the ground surface.

The direction of the force that is transmissible from the transmission device to the edge protector may deviate from the vertical direction by a maximum of +/−55°, preferably by a maximum of +/−45°.

The first coupling element and the second coupling element may be connected via a third articulated joint, wherein the third articulated joint is preferably connected neither to the machine frame nor to the edge protector.

The first coupling element may be connected to the machine frame via a fourth articulated joint.

The first articulated joint may be arranged on the first coupling element between the fourth and the third articulated joint.

The second end of the transmission device may move on a circular path.

The coupling elements may be intrinsically rigid.

A method for height-adjusting an edge protector of a construction machine, in particular road milling machine, stabilizer, recycler or surface miner, may furthermore be provided, which exhibits the following features:

adjusting the edge protector by means of at least one lifting device, which, on a first end, is connected to the machine frame, and, on a second end, is connected to the height-adjustable edge protector, wherein a second lifting device is used for adjustment in addition to the first lifting device, wherein the second lifting device applies the force for adjustment of the edge protector to a transmission device and the transmission device transmits the force to the side plate.

The transmission device may transmit the force to the edge protector essentially perpendicular in relation to the ground surface.

The first and the second lifting device may apply the forces simultaneously or successively.

Due to the arrangement of the second end of the first lifting device behind the center of gravity of the edge protector as seen in the direction of travel, and of the second end of the transmission device in front of the center of gravity of the edge protector as seen in the direction of travel, an adjustment is also possible in which the front end of the edge protector is raised or lowered by a different amount than the rear end of the edge protector.

BRIEF DESCRIPTION OF THE DRAWINGS

Hereinafter, embodiments of the invention are illustrated in more detail with reference to the drawings.

The following is shown schematically.

DETAILED DESCRIPTION

Figure 1:
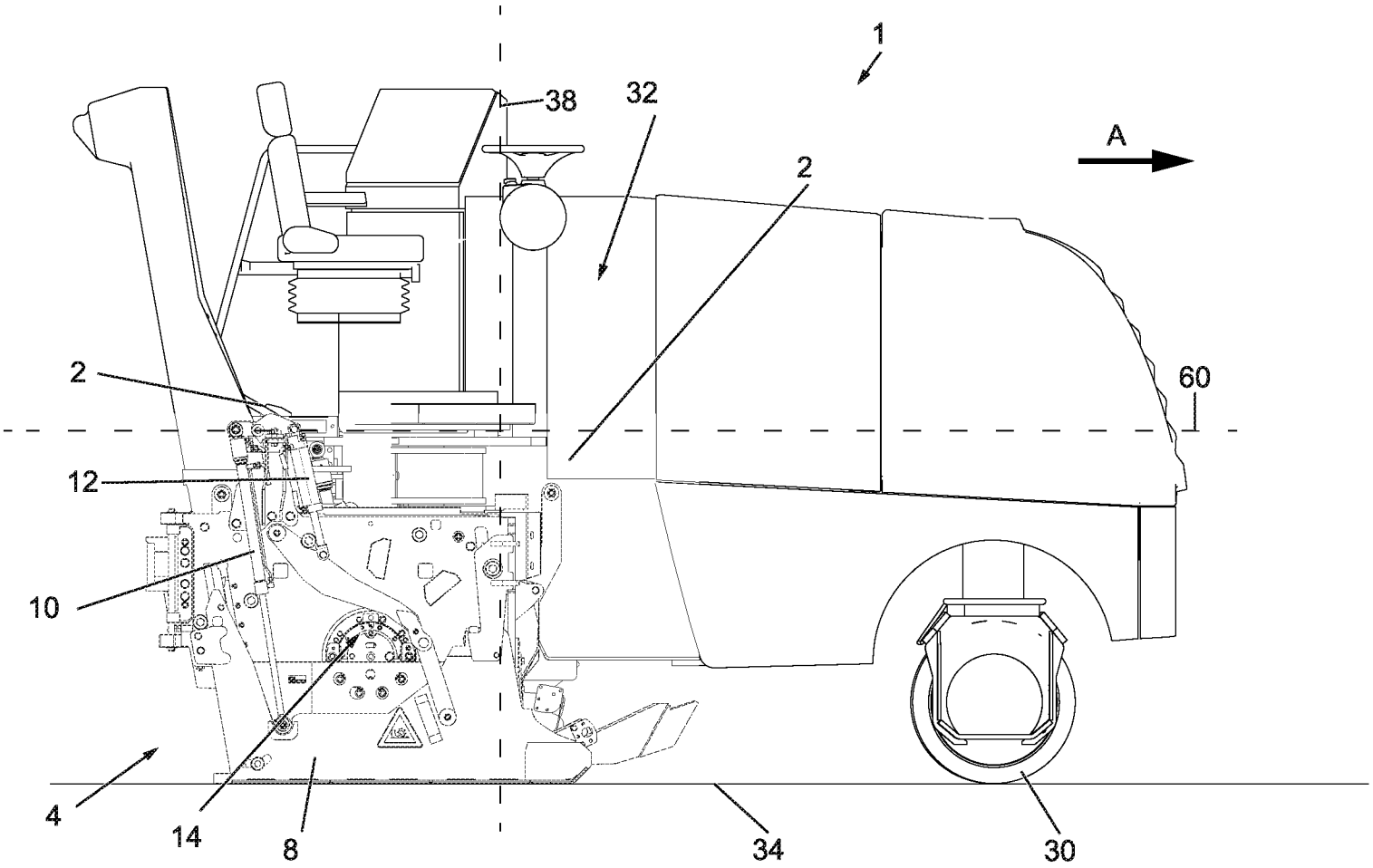
FIG. 1 a construction machine according to the present invention.

FIG. 1 shows a self-propelled construction machine 1. In the embodiment depicted, the self-propelled construction machine 1 is a road milling machine. Said construction machine 1 comprises a machine frame 2 and at least three travelling devices 30. The depicted construction machine 1 comprises two front and two rear travelling devices 30, of which only the right-hand front travelling device 30 is visible in FIG. 1 for reasons of clarity. In the construction machine according to FIG. 1, said travelling device would be arranged on the right-hand side of the housing 4 as seen in the direction of travel A. The rear travelling device arranged on the left-hand side as seen in the direction of travel A is covered, in FIG. 1, by the housing 4 which is rigidly connected to the machine frame. The rear travelling device arranged on the right-hand side as seen in the direction of travel A has been omitted in FIG. 1 for reasons of clarity in order to provide a better view of the milling drum housing. A pivotable travelling device has been described, for example, in DE 19631042 (U.S. Pat. No. 6,106,073). The travelling devices may be wheels, as in the embodiment depicted, or alternatively also tracked ground-engaging units.

The travelling devices 30 may be connected to the machine frame 2 via lifting columns. The machine frame 2 may be adjustable in height by means of the lifting columns. As a result, the working device 6, in particular milling drum, may also be adjusted in height relative to the ground 34. The lifting columns may be provided on all travelling devices 30. However, the lifting devices may, for example, also be arranged only on the rear travelling devices. The construction machine 1 exhibits a longitudinal direction 60. When the construction machine 1 is standing on a level ground surface and the front and rear lifting columns are extended to an equal degree, said longitudinal direction 60 is arranged parallel to the ground surface. Furthermore, the construction machine exhibits a vertical direction 38, which is arranged orthogonal to the longitudinal direction 60 and, when the construction machine 1 is standing on a level ground surface and the front and rear lifting columns are extended to an equal degree, is arranged orthogonal to the ground surface.

The travelling devices 30 may each be driven by means of at least one hydraulic drive system. In a construction machine 1, at least two of the travelling devices 30 may be driven, wherein, for example, the front travelling devices may also be non-driven. One of the at least three travelling devices 30 may be realized as a pivotable travelling device 30. Said travelling device 30 may be pivotable about at least one vertical pivoting axis in relation to the machine frame 2 between a first pivoted-in and at least one second pivoted-out position. In the embodiment depicted, the non-depicted rear travelling device 30 arranged on the right-hand side as seen in the direction of travel is realized as a pivotable travelling device.

The construction machine 1 may exhibit a so-called zero-clearance side. The working device 6 may, with its one front end, be arranged nearly flush with the zero-clearance side of the machine frame 2 so that close-to-edge working is possible on the zero-clearance side of the construction machine 1. For this purpose, the pivotable travelling device is pivoted, from a pivoted-out position beyond the zero-clearance side plane, inwards into a cutout 32 of the machine frame 2 so that the outer edge of the pivotable travelling device does not project beyond the zero-clearance side and may terminate preferably flush with the zero-clearance side.

The pivotable travelling device may also be pivotable into more than one outer pivoted-out position.

Furthermore, at least one working device 6 is provided, which, as in the embodiment depicted, may be a milling drum. The working device may work the ground pavement.

The at least one working device 6, in particular milling drum, is preferably arranged in a housing 4 open towards the bottom that is at least partially closed on at least one side by at least one edge protector 8 height-adjustable relative to the machine frame 2. Provided that the working device 6 is a milling drum, the housing 4 may also be termed milling drum housing. For the purposes of the present application, all parts rigidly connected to the supporting structure are part of the machine frame 2. All parts of the housing that are rigidly connected to the supporting structure of the construction machine 1 are therefore also part of the machine frame 2.

The housing 4 open towards the bottom may be closed towards the front as seen in the direction of travel A, and towards the rear as seen in the direction of travel A. A hold-down device may be provided, for example, towards the front as seen in the direction of travel A, and a scraper device may be arranged towards the rear as seen in the direction of travel. On the sides, the housing 4 open towards the bottom may be partially closed, at least on one side, by a height-adjustable edge protector 8. The edge protector 8 may also be termed a height-adjustable side plate. One height-adjustable edge protector 8 each is preferably provided on both sides of the housing 4.

The at least one edge protector 8 may be raised and lowered. The edge protector may rest on the ground 34. During the advance movement of the construction machine 1, the edge protector 8 may be pulled across the ground 34. In the process, the edge protector 8 may additionally be loaded or relieved by applying a predetermined force.

The edge protector 8 may be raised, for example, if an obstacle is to be avoided, or when driving onto a curb, for example, or if jamming is to be prevented. During the operation of the construction machine, however, the edge protector 8 is preferably lowered so that the housing 4 is closed. The edge protector preferably rests on the milling edge during operation, that is, on the area that is not milled, and prevents fracturing of the area not to be milled.

The edge protector 8 is preferably guided inside the housing via two guides. The guides preferably each comprise one upper and one lower limit stop. The guides may be realized, for example, as grooves. In this case, for example, bolts may be provided on the edge protector 8, which are guided in the respective grooves.

The edge protector 8 may also perform small rotatory movements. This may be rendered possible, for example, by means of a certain amount of play in the respective guide.

Figure 2:
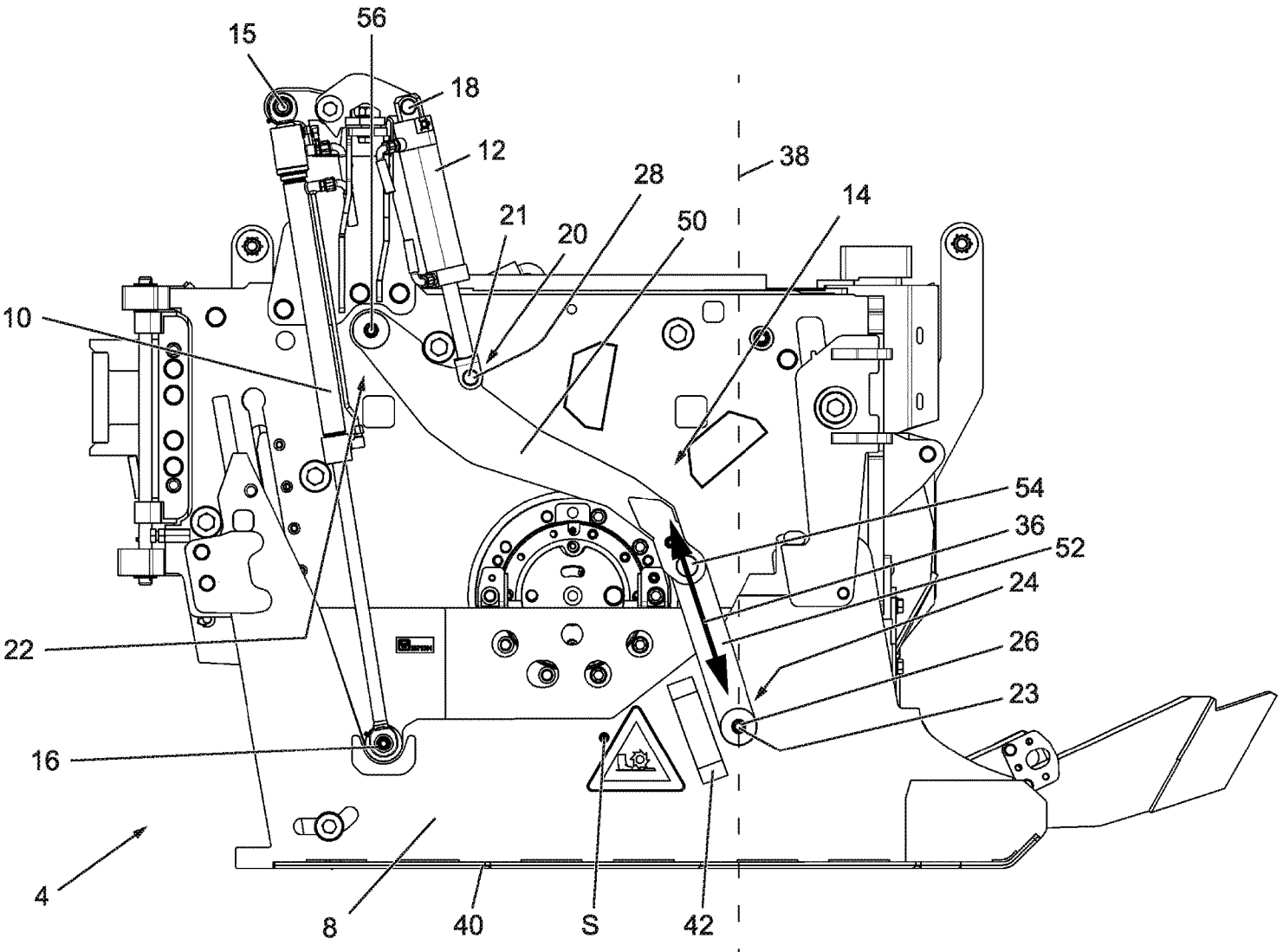
FIG. 2 side view of the housing of the working device.

At least one first lifting device 10 and second lifting device 12 are provided for the purpose of height adjustment of the edge protector. The first and second lifting devices 10 and 12 may also be referred to as first and second lifting actuators 10 and 12. Adjustment of the height can be illustrated in more detail with reference to FIGS. 2 and 3. The first end 15 of the lifting device 10 is connected to the machine frame 2, and the second end 16 of the same is connected to the height-adjustable edge protector 8. The second lifting device 12 is connected, with a first end 18, to the machine frame 2, and is connected, with a second end 20, to a first end 22 of a transmission device 14, which is in turn connected, with a second end 24, to the height-adjustable edge protector 8. The transmission device 14 may also be referred to as a transmission linkage 14.

Due to the transmission device 14, the point of application of the force of the second lifting device 12 is arbitrarily determinable. The point of application of the force would normally be in the position designated with reference symbol 28. Due to the transmission device 14, however, the point of application of the force of the second lifting device is in the position designated with reference symbol 26. The force applied by the second lifting device 12 therefore acts on the edge protector 8 at the point of application 26.

Due to the transmission device 14, the direction of force of the force of the second lifting device 12 transmitted to the edge protector 8 may also be arbitrarily determinable. If the second lifting device 12 were directly connected to the point of application 26, the force transmitted by the second lifting device 12 would have a significantly higher force component acting in the longitudinal direction. In the present invention, one advantage is that the force component of the force 36 acting in the vertical direction is significantly higher. The force component of the force 36 acting in the vertical direction causes the edge protector 8 to be raised and lowered. Furthermore, providing the transmission device 14 offers the advantage that the force component of the force 36 acting in the longitudinal direction is small. The force component of the force 36 acting in the longitudinal direction would contribute to jamming.

The transmission device 14 is therefore preferably arranged and designed in such a fashion that the force 36, which is transmitted from the transmission device 14 to the edge protector 8, acts essentially perpendicular in relation to the ground surface 34. The force transmissible from the transmission device 14 to the edge protector 8 preferably deviates from the vertical direction 38 by a maximum of +/−55°.

The first end 15 of the first lifting device 10 is connected to the machine frame 2.

The second end 16 of the first lifting device 10 is connected to the height-adjustable edge protector 8 in the rear section 40 of the edge protector 8 as seen in the direction of travel A of the construction machine 1, and wherein the second end 24 of the transmission device 14 is connected to the front section 42 of the edge protector 8 as seen in the direction of travel A of the construction machine 1. The front section 42 of the edge protector 8 may be that section of the height-adjustable edge protector 8 which is located in front of the center of gravity S of the height-adjustable edge protector 8 as seen in the direction of travel A of the construction machine 1, wherein the rear section 40 of the height-adjustable edge protector 8 is that section of the edge protector 8 which is located behind the center of gravity S of the edge protector 8 as seen in the direction of travel of the construction machine 1.

In the present case, the direction of travel A is the forward direction of the construction machine 1. Alternatively, the construction machine could be designed in such a fashion that the second end 16 of the first lifting device 10 is connected to the height-adjustable edge protector 8 in the front section 42 of the edge protector 8 as seen in the forward direction of the construction machine 1, and wherein the second end 24 of the transmission device 14 is connected to the rear section 40 of the edge protector 8 as seen in the forward direction of the construction machine 1.

In the present case, the second lifting device 12 is connected to at least one first coupling element 50 via a first articulated joint 21, and the edge protector 8 is connected, in the present case, to at least one second coupling element 52 via a second articulated joint 23. The second articulated joint 23 may be referred to as a lower articulated joint 23. The coupling elements 50, 52 may be designed as rod elements as in the embodiment depicted. The coupling elements may therefore be intrinsically rigid. The coupling elements 50, 52 may also be rigid links 50, 52, which may for example be constructed as planar link elements.

The first coupling element and the second coupling element 50, 52 may be connected via a third articulated joint 54, wherein the third articulated joint 54 may be connected neither to the machine frame 2 nor to the edge protector 8. The third articulated joint 54 may also be referred to as an intermediate articulated joint 54.

The first coupling element 50 may be connected to the machine frame 2 via a fourth articulated joint 56. Fourth articulated joint 56 may be referred to as an upper articulated joint 56.

The first articulated joint 21 may be arranged on the first coupling element 50 between the fourth 56 and the third articulated joint 54.

The transmission linkage 14 may also be described as including first link 50 and second link 52. The first link 50 may include an upper end pivotally connected to the machine frame 2 at the upper articulated joint 56. The second link 52 may include an upper end pivotally connected to a lower end of the first link 50 at intermediate articulated joint 54, and a lower end pivotally connected to the front section of the height-adjustable edge protector 8 at the lower articulated joint 26. The lower end of the second lifting actuator 12 may be pivotally connected to the first link 50 at the first articulated joint 21 between the upper articulated joint 56 and the intermediate articulated joint 54.

Figure 3:
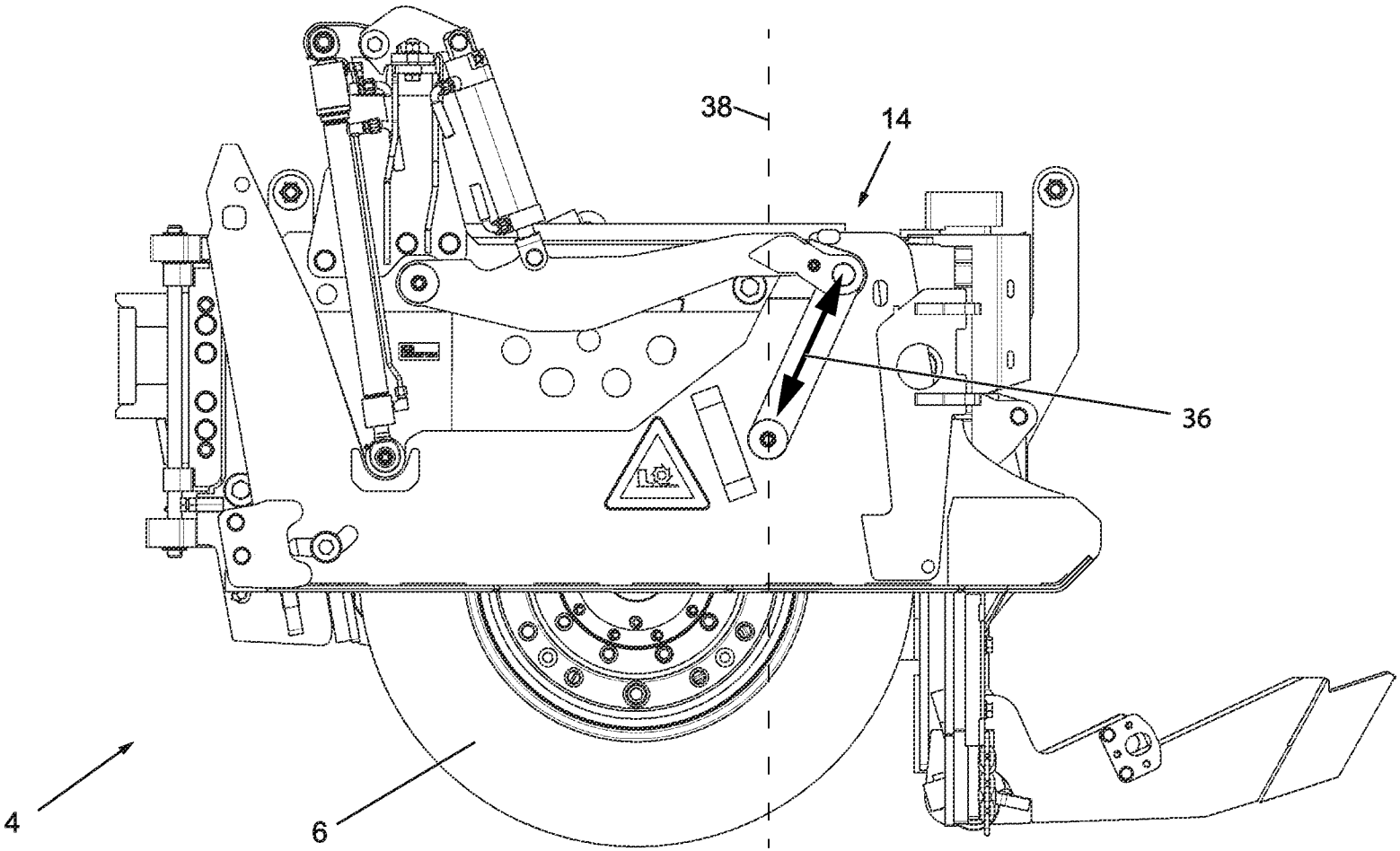
FIG. 3 side view of the housing according to FIG. 2 with raised edge protector.

In FIG. 3, the edge protector 8 is raised. The movement of the transmission device 14 becomes clear from FIGS. 2 and 3. The second coupling element 52 pivots about the second articulated joint 23. In the process, the second coupling element 52 is, however, essentially perpendicular to the ground surface or does not deviate from the vertical 38 by more than +/−55°, respectively. The first coupling element 50 pivots about the fourth articulated joint 56. The first coupling element 50 is driven by the second lifting device 12. The first and the second coupling element 50, 52 are connected to one another via the third articulated joint 54 so that a movement of the first coupling element 50 leads to a movement of the second coupling element 52.

The invention claimed is:

1. A self-propelled construction machine, comprising:

a machine frame;

a milling drum;

a milling drum housing receiving the milling drum, the milling drum housing including an open bottom and at least one height-adjustable edge protector at least partially closing at least one side of the housing, the height-adjustable edge protector being height adjustable relative to the machine frame;

a first lifting actuator including a first end connected to the machine frame and a second end connected to the height-adjustable edge protector;

a transmission linkage connected to the height-adjustable edge protector;

a second lifting actuator including a first end connected to the machine frame and a second end connected to the transmission linkage;

wherein the height-adjustable edge protector includes a front section and a rear section, the front section being located ahead of a center of gravity of the height-adjustable edge protector as seen in a direction of travel, and the rear section being located behind the center of gravity of the height-adjustable edge protector as seen in the direction of travel;

wherein the second end of the first lifting actuator is connected to the rear section of the height-adjustable edge protector; and wherein the transmission linkage is connected to the front section of the height-adjustable edge protector.

2. The self-propelled construction machine of claim 1, wherein:

the transmission linkage is configured such that a point of application of and a direction of a lifting force applied to the height-adjustable edge protector by the second lifting actuator is determined by a location of a point of connection of the transmission linkage to the height-adjustable edge protector.

3. The self-propelled construction machine of claim 1, wherein:

the transmission linkage includes a lever arm.

4. The self-propelled construction machine of claim 1, wherein:

the transmission linkage is configured such that a direction of a lifting force applied to the height-adjustable edge protector by the transmission linkage acts perpendicular to a ground surface when the machine frame is oriented parallel to the ground surface.

5. The self-propelled construction machine of claim 1, wherein:

the transmission linkage is configured such that a direction of a lifting force applied to the height-adjustable edge protector by the transmission linkage deviates from a vertical direction by a maximum of +/−55° when the machine frame is oriented horizontally.

6. The self-propelled construction machine of claim 1, wherein:

the transmission linkage is configured such that a force applied to the height-adjustable edge protector by the transmission linkage is transmissible in two directions so that the height-adjustable edge protector can be raised or lowered by the transmission linkage.

7. A self-propelled construction machine, comprising:

a machine frame;

a milling drum;

a milling drum housing receiving the milling drum, the milling drum housing including an open bottom and at least one height-adjustable edge protector at least partially closing at least one side of the housing, the height-adjustable edge protector being height adjustable relative to the machine frame;

a first lifting actuator including a first end connected to the machine frame and a second end connected to the height-adjustable edge protector;

a transmission linkage connected to the height-adjustable edge protector;

a second lifting actuator including a first end connected to the machine frame and a second end connected to the transmission linkage; and wherein the transmission linkage includes at least two links and at least three articulated joints.

8. A self-propelled construction machine, comprising:

a machine frame;

a milling drum;

a milling drum housing receiving the milling drum, the milling drum housing including an open bottom and at least one height-adjustable edge protector at least partially closing at least one side of the housing, the height-adjustable edge protector being height adjustable relative to the machine frame;

a first lifting actuator including a first end connected to the machine frame and a second end connected to the height-adjustable edge protector;

a transmission linkage connected to the height-adjustable edge protector;

a second lifting actuator including a first end connected to the machine frame and a second end connected to the transmission linkage; and wherein the transmission linkage includes a first link, a second link, a first articulated joint connecting the second lifting actuator to the first link, and a second articulated joint connecting the second link to the height-adjustable edge protector.

9. The self-propelled construction machine of claim 8, wherein:

the transmission linkage further includes a third articulated joint connecting the first link and the second link, the third articulated joint being connected neither to the machine frame nor to the height-adjustable edge protector.

10. A self-propelled construction machine, comprising:

a machine frame;

a milling drum;

a milling drum housing receiving the milling drum, the milling drum housing including an open bottom and at least one height-adjustable edge protector at least partially closing at least one side of the housing, the height-adjustable edge protector being height adjustable relative to the machine frame;

a first lifting actuator including a first end connected to the machine frame and a second end connected to the height-adjustable edge protector;

a transmission linkage connected to the height-adjustable edge protector;

a second lifting actuator including a first end connected to the machine frame and a second end connected to the transmission linkage; and wherein the transmission linkage is configured such that a connection of the transmission linkage to the height-adjustable edge protector moves on a circular path.

11. A self-propelled construction machine, comprising:

a machine frame;

a milling drum;

a milling drum housing receiving the milling drum, the milling drum housing including an open bottom and at least one height-adjustable edge protector at least partially closing at least one side of the housing, the height-adjustable edge protector being height adjustable relative to the machine frame;

a first lifting actuator including a first end connected to the machine frame and a second end connected to the height-adjustable edge protector;

a transmission linkage connected to the height-adjustable edge protector;

a second lifting actuator including a first end connected to the machine frame and a second end connected to the transmission linkage; and wherein the transmission linkage includes at least two rigid links and at least three articulated joints.

12. A method of adjusting a height of an edge protector of a self-propelled construction machine, the method comprising:

(a) adjusting the height of a first end section of the edge protector with a first lifting actuator connected on a first end to a machine frame of the construction machine and on a second end to the edge protector; and (b) adjusting the height of a second end section of the edge protector with a second lifting actuator applying a lifting force to the edge protector through a transmission linkage, the transmission linkage including at least two links and at least three articulated joints.

13. The method of claim 12, wherein:

in step (b) the transmission linkage applies the lifting force to the edge protector such that a direction of a lifting force applied to the edge protector by the transmission linkage deviates from a vertical direction by a maximum of +/−55° when the machine frame is oriented horizontally.

14. The method of claim 12, wherein:

steps (a) and (b) are performed simultaneously.

15. The method of claim 12, wherein:

steps (a) and (b) are performed successively.

16. A self-propelled construction machine, comprising:

a machine frame;

a milling drum;

a milling drum housing receiving the milling drum, the milling drum housing including an open bottom and at least one height-adjustable edge protector at least partially closing at least one side of the housing, the height-adjustable edge protector including a front section and a rear section, the front section being located ahead of a center of gravity of the height-adjustable edge protector as seen in a direction of travel, and the rear section being located behind the center of gravity of the height-adjustable edge protector as seen in the direction of travel;

a first lifting actuator including an upper end connected to the machine frame and a lower end connected to the rear section of the height-adjustable edge protector;

a second lifting actuator including an upper end connected to the machine frame; and a transmission linkage including:

a first link including an upper end pivotally connected to the machine frame at an upper articulated joint;

a second link having an upper end pivotally connected to a lower end of the first link at an intermediate articulated joint and having a lower end pivotally connected to the front section of the height-adjustable edge protector at a lower articulated joint; and wherein a lower end of the second lifting actuator is pivotally connected to the first link between the upper articulated joint and the intermediate articulated joint.

17. The self-propelled construction machine of claim 16, wherein:

the transmission linkage is configured such that a direction of a lifting force applied to the height-adjustable edge protector by the transmission linkage deviates from a vertical direction by a maximum of +/−55° when the machine frame is oriented horizontally.

18. The self-propelled construction machine of claim 16, wherein:

the second lifting actuator is located forward of the first lifting actuator.

19. The self-propelled construction machine of claim 18, wherein:

the second lifting actuator is shorter than the first lifting actuator.

* * * * *